US009866968B2

(12) United States Patent
Yoo

(10) Patent No.: US 9,866,968 B2
(45) Date of Patent: Jan. 9, 2018

(54) MICROPHONE AND MANUFACTURING METHOD OF MICROPHONE

(71) Applicant: HYUNDAI MOTOR COMPANY, Seoul (KR)

(72) Inventor: Ilseon Yoo, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 15/163,406

(22) Filed: May 24, 2016

(65) Prior Publication Data

US 2017/0171667 A1 Jun. 15, 2017

(30) Foreign Application Priority Data

Dec. 9, 2015 (KR) ..... 10-2015-0175331

(51) Int. Cl.
*H04R 25/00* (2006.01)
*H04R 9/08* (2006.01)
*H04R 31/00* (2006.01)

(52) U.S. Cl.
CPC ..... *H04R 9/08* (2013.01); *H04R 31/00* (2013.01)

(58) Field of Classification Search
CPC ..... H04R 9/08; H04R 31/00
See application file for complete search history.

(56) References Cited

U.S. PATENT DOCUMENTS

| | | | | |
|---|---|---|---|---|
| 8,467,548 | B2 | 6/2013 | Karunasiri et al. | |
| 2011/0158454 | A1* | 6/2011 | Takano | H04R 1/04 381/369 |
| 2012/0213400 | A1* | 8/2012 | Kasai | H04R 19/04 381/369 |
| 2014/0050338 | A1* | 2/2014 | Kasai | H04R 19/04 381/174 |
| 2015/0156576 | A1* | 6/2015 | Uchida | H04R 7/06 381/174 |
| 2016/0084729 | A1* | 3/2016 | Huseynov | G01S 3/808 73/40.5 A |
| 2016/0212551 | A1* | 7/2016 | Hsu | B81C 1/00182 |
| 2017/0142525 | A1* | 5/2017 | Glacer | B81B 3/0021 |

FOREIGN PATENT DOCUMENTS

| | | | |
|---|---|---|---|
| KR | 10-0544276 | B1 | 1/2006 |
| KR | 10-2007-0031512 | A | 3/2007 |
| KR | 10-1089828 | B1 | 12/2011 |
| KR | 10-2012-0029839 | A | 3/2012 |
| KR | 10-1354960 | B1 | 1/2014 |
| KR | 10-1558393 | B1 | 10/2015 |

* cited by examiner

*Primary Examiner* — Simon King
(74) *Attorney, Agent, or Firm* — McDermott Will & Emery LLP

(57) ABSTRACT

A microphone includes a plurality of vibration membrane electrodes, and a plurality of fixing membrane electrodes that respectively faces the plurality of vibration membrane electrodes and forms a plurality of unit capacitors along with the facing vibration membrane electrodes, wherein the plurality of unit capacitors generates a plurality of unit output signals according to inputs of a power source and a sound source, and outputs a signal combining the plurality of unit output signals as an output signal corresponding to the sound source.

10 Claims, 11 Drawing Sheets

MICROPHONE AND MANUFACTURING METHOD OF MICROPHONE

CROSS-REFERENCE TO RELATED APPLICATION

This application claims the benefit of priority to Korean Patent Application No. 10-2015-0175331, filed with the Korean Intellectual Property Office on Dec. 9, 2015, the entire contents of which are incorporated herein by reference.

TECHNICAL FIELD

The present disclosure relates to a microphone and a manufacturing method of the microphone.

BACKGROUND

A micro-electro-mechanical systems (MEMS) microphone, which converts a sound signal into an electrical signal, may be manufactured by a semiconductor batch process. Since the MEMS microphone has excellent sensitivity, low performance deviation for each product, and strong humidity resistance and heat resistance compared with an electret condenser microphone (ECM) which is currently mostly used in vehicles, and may be manufactured in a small-sized type, the ECM has recently been increasingly replaced with the MEMS microphone.

Unlike a microphone used in a mobile phone, since the microphone used in the vehicle is disposed far from a sound source and is positioned in a harsh environment in which noises variously occur in a vehicle, it is required to develop a microphone that is performs well in a noisy environment inside the vehicle.

For this purpose, by arranging MEMS microphones in an array type and applying a beam forming technique thereto, a directional scheme of receiving only a sound from a desired direction may be used. However, as such a directional array MEMS microphone includes two or more digital MEMS microphones and a digital signal processing (DSP) chip, the manufacturing cost thereof is excessive, thus it is difficult to apply it to the vehicle.

Accordingly, it is required to develop a directional MEMS microphone that exists as a single element.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide a microphone and a manufacturing method thereof in which directivity is realized in a single element level.

An exemplary embodiment of the present disclosure provides a microphone including: a plurality of vibration membrane electrodes; and a plurality of fixing membrane electrodes that respectively faces the plurality of vibration membrane electrodes and forms a plurality of unit capacitors along with the facing vibration membrane electrodes, wherein the plurality of unit capacitors may generate a plurality of unit output signals according to inputs of a power source and a sound source, and may output a signal combining the plurality of unit output signals as an output signal corresponding to the sound source.

Phases of the plurality of unit output signals may be the same when an incident direction of the sound source is a predetermined incident direction.

The plurality of vibration membrane electrodes may be positioned on the same plane, and the plane may be perpendicular to the predetermined incident direction.

Each of the plurality of vibration membrane electrodes may be positioned to be spaced apart at equal intervals from a reference point which is a contact point of the predetermined incident direction and the plane.

The microphone may further include a plurality of vibration membrane patterns that respectively correspond to the plurality of vibration membrane electrodes, wherein the plurality of vibration membrane patterns may include a plurality of concentric grooves extending from the reference point.

The plurality of fixing membrane electrodes may include a plurality of openings.

The microphone may further include a fixing membrane that contacts the plurality of fixing membrane electrodes, wherein the fixing membrane may include a plurality of openings corresponding to the plurality of fixing membrane electrodes.

The microphone may further include a substrate that contacts the fixing membrane, wherein the substrate may include openings corresponding to the plurality of openings of the fixing membrane.

Each of the plurality of vibration membrane patterns may be connected to each other at a position corresponding to the reference point, and the microphone may further include a spring pattern connected to the position corresponding to the reference point.

The predetermined incident direction may be changed by delaying a phase of the unit output signal.

Another embodiment of the present disclosure provides a manufacturing method of a microphone, including: forming a fixing membrane on a substrate; forming a plurality of fixing membrane electrodes on the fixing membrane; forming a sacrificial layer on the plurality of fixing membrane electrodes; forming a plurality of vibration membrane electrodes on the sacrificial layer; forming a vibration membrane on the plurality of vibration membrane electrodes; forming a plurality of vibration membrane patterns respectively corresponding to the plurality of vibration membrane electrodes by patterning the vibration membrane; forming an opening by back-etching the substrate, the fixing membrane, and the plurality of fixing membrane electrodes; and removing some of the sacrificial layer positioned between the plurality of vibration membrane electrodes and the plurality of fixing membrane electrodes through the opening.

The substrate may be a silicon substrate, and the manufacturing method may further include thermal-oxidizing the substrate.

The forming of the plurality of vibration membrane patterns may include exposing a plurality of first pad electrodes corresponding to the plurality of vibration membrane electrodes by patterning the vibration membrane.

The manufacturing method may further include exposing a plurality of second pad electrodes corresponding to the plurality of fixing membrane electrodes by etching the sacrificial layer.

Each of the plurality of vibration membrane electrodes may be positioned on the same plane and may be positioned to be spaced apart at equal intervals based on a reference point.

The plurality of vibration membrane patterns may include a plurality of concentric grooves.

The forming of the plurality of vibration membrane patterns may include forming a spring pattern supporting the plurality of vibration membrane patterns by patterning the vibration membrane.

The plurality of fixing membrane electrodes may include a plurality of openings, and the fixing membrane may include a plurality of openings that are formed at positions corresponding to the plurality of fixing membrane electrodes.

The substrate may include openings corresponding to the plurality of openings of the fixing membrane.

The sacrificial layer may include an opening corresponding to the substrate.

According to the embodiment of the present disclosure, it is possible to provide a microphone and a manufacturing method thereof in which directivity is realized in a single element level.

DETAILED DESCRIPTION

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

Figure 1:
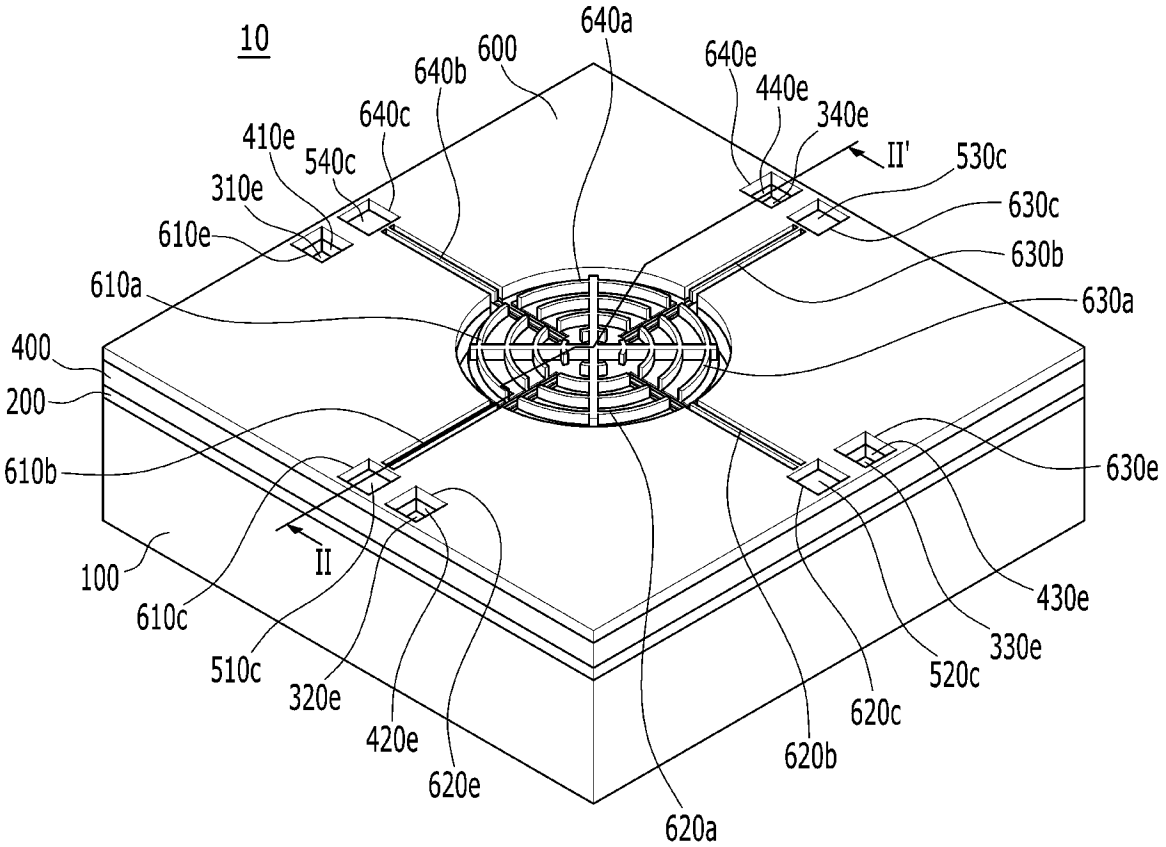
FIG. 1 illustrates a perspective view of a microphone according to an exemplary embodiment of the present disclosure.
Figure 2:
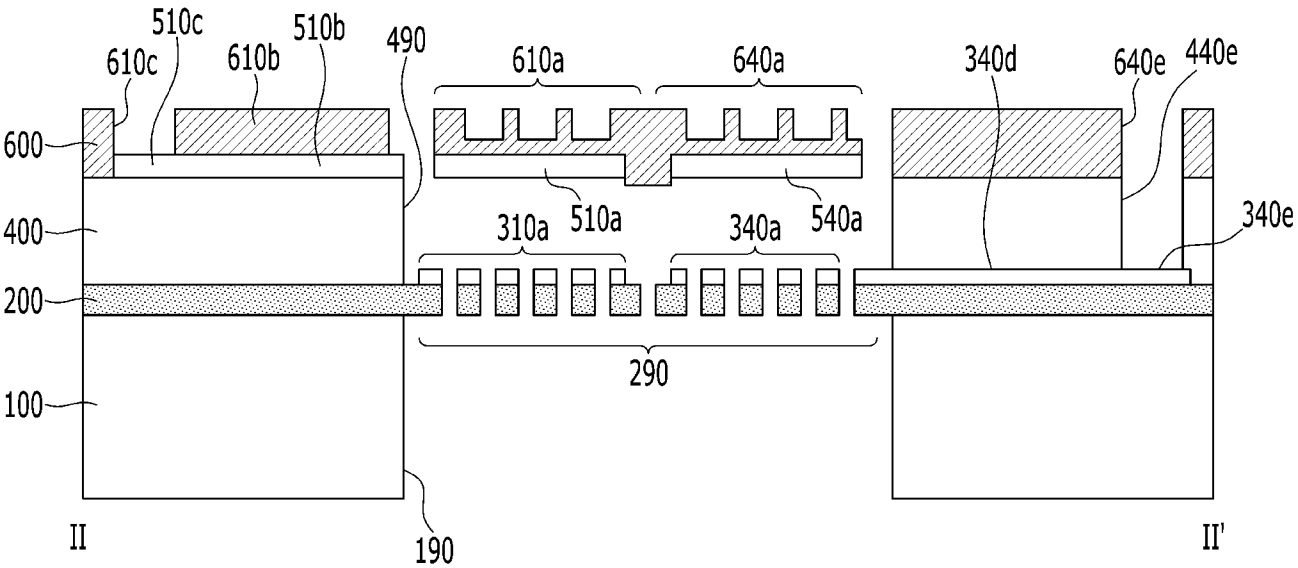
FIG. 2 illustrates a cross-sectional view of the microphone taken along line II-II' of FIG. 1.

FIG. 1 illustrates a perspective view of a microphone according to an exemplary embodiment of the present disclosure, and FIG. 2 illustrates a cross-sectional view of the microphone taken along line II-II' of FIG. 1.

Referring FIGS. 1 and 2, a microphone 10 according to an exemplary embodiment of the present disclosure may includes a substrate 100, a fixing membrane 200, a plurality of fixing membrane electrodes 310*a* and 340*a*, a sacrificial layer 400, a plurality of vibration membrane electrodes 510*a* and 540*a*, and a vibration membrane 600.

The substrate 100 may include a silicon wafer. The substrate 100 may be a silicon wafer treated by thermal oxidation. In this case, a surface of the substrate 100 may be a silicon oxide ($SiO_2$).

The substrate 100 may be provided with an opening 190. The opening 190 may assist the vibration membrane 600 to freely vibrate by allowing a flow of air. The opening 190 may be formed to have a size including a plurality of openings 290 provided in the fixing membrane 200. The opening 190 may be formed to have a size including a planar area of the plurality of fixing membrane electrodes 310*a* and 340*a* or the plurality of vibration membrane electrodes 510*a* and 540*a*.

The fixing membrane 200 may be positioned on the substrate 100. The fixing membrane 200 may include the plurality of openings 290, and since the plurality of openings 290 allow a flow of air, the fixing membrane 200 may not vibrate or may minimally vibrate by a sound source. The fixing membrane 200 may be made of an insulating material, and for example, may include a silicon nitride (SiN) material. Alternatively, the fixing membrane 200 may include polysilicon.

The plurality of fixing membrane electrodes 310*a* and 340*a* may be positioned on the fixing membrane 200. Although two fixing membrane electrodes 310*a* and 340*a* are illustrated in FIG. 2, the microphone 10 may include four fixing membrane electrodes 310*a*, 320*a*, 330*a*, and 340*a* in the exemplary embodiment of FIG. 4. The plurality of fixing membrane electrodes 310*a*, 320*a*, 330*a*, and 340*a* may respectively include a conductive material, and for example, may respectively include gold (Au) and chromium (Cr).

The fixing membrane electrode 340*a* may be connected to a second pad electrode 340*e* through a conductive line 340*d*. The fixing membrane electrode 340*a*, the conductive line 340*d*, and the second pad electrode 340*e* may be formed at one time by patterning one conductive material. Although not illustrated in FIG. 2, referring to FIG. 4, other fixing membrane electrodes 310*a*, 320*a*, and 330*a* may be respectively connected to corresponding conductive lines 310*d*, 320*d*, and 330*d*, and corresponding second pad electrodes 310*e*, 320*e*, and 330*e*.

The sacrificial layer 400 may be positioned on the fixing membrane 200 and the fixing membrane electrodes 310*a*, 320*a*, 330*a*, and 340*a*. The sacrificial layer 400 may include an opening 490 corresponding to the opening 190 of the substrate 100. The sacrificial layer 400 may include a plurality of second contact holes 410*e*, 420*e*, 430*e*, and 440*e*. The sacrificial layer 400 may include a silicon oxide ($SiO_2$).

The plurality of vibration membrane electrodes 510*a* and 540*a* may be positioned on the opening 490 of the sacrificial layer 400. Although two vibration membrane electrodes 510*a* and 540*a* are illustrated in FIG. 2, the microphone 10 shown in FIG. 3 may include four vibration membrane electrodes 510*a*, 520*a*, 530*a*, and 540*a*. The plurality of vibration membrane electrodes 510*a*, 520*a*, 530*a*, and 540*a* may respectively include a conductive material, and the conductive material may be the same material as those of the plurality of fixing membrane electrodes 310*a*, 320*a*, 330*a*, and 340*a*. For example, the plurality of vibration membrane electrodes 510*a*, 520*a*, 530*a*, and 540*a* may respectively include gold (Au) and chromium (Cr).

The vibration membrane electrode 510*a* may be connected to a first pad electrode 510*c* through a conductive line 510*b*. The vibration membrane electrode 510*a*, the conductive line 510*b*, and the first pad electrode 510*c* may be formed at one time by patterning one conductive material. Although not illustrated in FIG. 2, the vibration membrane electrodes 520*a*, 530*a*, and 540*a* may be respectively connected to corresponding conductive lines 520*b*, 530*b*, and 540*b* and corresponding first pad electrodes 520*c*, 530*c* and 540*c*.

The vibration membrane 600 may be positioned on the sacrificial layer 400 and the plurality of vibration membrane electrodes 510*a* and 540*a*. The vibration membrane 600 may be made of an insulating material, which, for example, may include a silicon nitride (SiN). Alternatively, the vibration membrane 600 may be made of polysilicon.

The vibration membrane 600 may include vibration membrane patterns 610*a*, 620*a*, 630*a* and 640*a*, spring patterns 610*b*, 620*b*, 630*b* and 640*b*, a plurality of first contact holes 610*c*, 620*c*, 630*c* and 640*c*, and a plurality of second contact holes 610*e*, 620*e*, 630*e* and 640*e*.

Each of the plurality of vibration membrane patterns 610*a*, 620*a*, 630*a*, and 640*a* may be positioned to correspond to each of the plurality of vibration membrane electrodes 510*a*, 520*a*, 530*a*, and 540*a*. The plurality of vibration membrane patterns 610*a*, 620*a*, 630*a*, and 640*a* may be disposed to form a circular shape. Each of the vibration membrane patterns 610*a*, 620*a*, 630*a*, and 640*a* may be a quarter of the circular shape in a planar view. The vibration membrane patterns 610*a*, 620*a*, 630*a*, and 640*a* may include a plurality of concentric grooves extending from a center of the microphone 10. The vibration membrane patterns 610*a*, 620*a*, 630*a*, and 640*a* provided with the plurality of concentric grooves may provide a directional vibration mode according to the incident direction of the sound source. This will be described in detail with reference to FIGS. 5A to 5C.

The spring patterns 610*b*, 620*b*, 630*b*, and 640*b* may support the vibration membrane patterns 610*a*, 620*a*, 630*a*, and 640*a*, and allow the vibration membrane patterns 610*a*, 620*a*, 630*a*, and 640*a* to freely vibrate. The spring patterns 610*b*, 620*b*, 630*b*, and 640*b* may overlap with the conductive lines 510*b*, 520*b*, 530*b*, and 540*b*.

The plurality of first contact holes 610*c*, 620*c*, 630*c*, and 640*c* may expose the plurality of first pad electrodes 510*c*, 520*c*, 530*c*, and 540*c* to the outside. The first pad electrodes 510*c*, 520*c*, 530*c*, and 540*c* may be electrically connected to a power source of the microphone 10.

The plurality of second contact holes 610*e*, 620*e*, 630*e*, and 640*e* may be positioned to correspond to the plurality of second contact holes 410*e*, 420*e*, 430*e*, and 440*e* of the sacrificial layer 400, and expose the second pad electrodes 310*e*, 320*e*, 330*e*, and 340*e*. The second pad electrodes 310*e*, 320*e*, 330*e*, and 340*e* may be electrically connected to the power source of the microphone 10.

Figure 3:
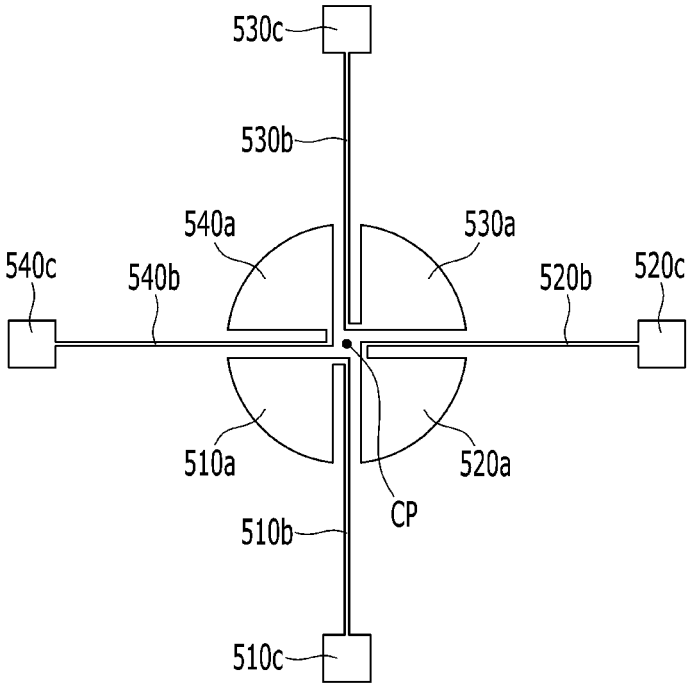
FIG. 3 illustrates a schematic view for explaining a vibration membrane electrode according to an exemplary embodiment of the present disclosure.

FIG. 3 illustrates a schematic view for explaining a vibration membrane electrode according to an exemplary embodiment of the present disclosure.

Referring to FIG. 3, the vibration membrane electrodes 510*a*, 520*a*, 530*a*, and 540*a* may be positioned on the same plane, and they may be positioned to be spaced apart at equal intervals from a reference point (CP). The plane on which the vibration membrane electrodes 510*a*, 520*a*, 530*a*, and 540*a* are disposed may be perpendicular to a predetermined incident direction of the sound source. The predetermined incident direction may mean an incident direction on the microphone 10 from a desired directional sound source. The reference point (CP) may be a contact point of the predetermined incident direction and the plane on which the vibration membrane electrodes 510*a*, 520*a*, 530*a*, and 540*a* are disposed.

Referring to FIG. 1 again, the plurality of vibration membrane patterns 610*a*, 620*a*, 630*a*, and 640*a* may be connected to each other at a position corresponding to the reference point (CP), and the spring patterns 610*b*, 620*b*, 630*b*, and 640*b* may be connected to the position corresponding to the reference point (CP).

The plurality of vibration membrane electrodes 510*a*, 520*a*, 530*a*, and 540*a* may be disposed to form a circular shape. Each of the vibration membrane electrodes 510*a*, 520*a*, 530*a*, and 540*a* may be a, or substantially a, quarter of the circular shape.

The vibration membrane electrodes 510*a*, 520*a*, 530*a*, and 540*a* may be respectively connected to the first pad electrodes 510*c*, 520*c*, 530*c*, and 540*c* through the conductive lines 510*b*, 520*b*, 530*b*, and 540*b*.

Figure 4:
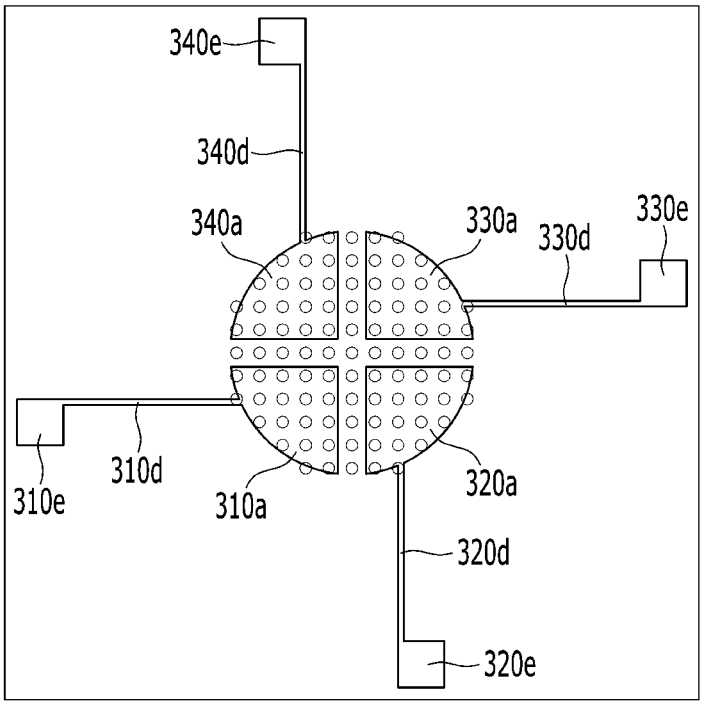
FIG. 4 illustrates a schematic view for explaining a fixing membrane electrode according to an exemplary embodiment of the present disclosure.

FIG. 4 illustrates a schematic view for explaining a fixing membrane electrode according to an exemplary embodiment of the present disclosure.

Referring to FIG. 4, the plurality of fixing membrane electrodes 310*a*, 320*a*, 330*a*, and 340*a* and the fixing membrane 200 are shown.

The fixing membrane electrodes 310*a*, 320*a*, 330*a*, and 340*a* may be positioned to correspond to the vibration membrane electrodes 510*a*, 520*a*, 530*a*, and 540*a* in a planar view. The fixing membrane electrodes 310*a*, 320*a*, 330*a*, and 340*a* may be disposed to form a circular shape. Each of the fixing membrane electrodes 310*a*, 320*a*, 330*a*, and 340*a* may be a, or substantially a, quarter of the circular shape.

The fixing membrane electrodes 310*a*, 320*a*, 330*a*, and 340*a* may be respectively connected to the second pad electrodes 310*e*, 320*e*, 330*e*, and 340*e* through the conductive lines 310*d*, 320*d*, 330*d*, and 340*d*.

The fixing membrane electrodes 310*a*, 320*a*, 330*a*, and 340*a* may include a plurality of openings, and the fixing membrane 200 may include a plurality of openings corresponding to the openings of the fixing membrane electrodes. Accordingly, air may flow through the openings of the fixing membrane electrodes 310*a*, 320*a*, 330*a*, and 340*a* and the fixing membrane 200.

Figure 5A:
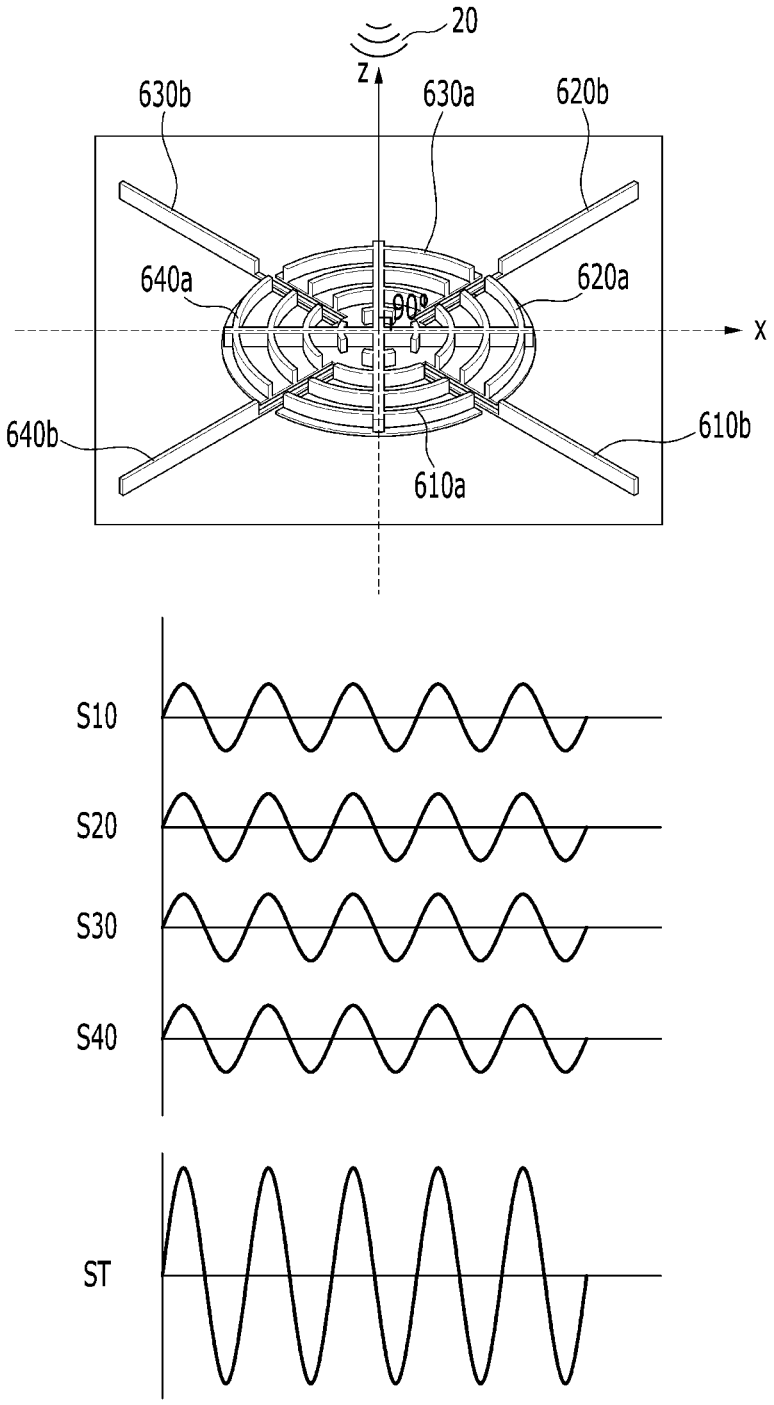
FIG. 5A to FIG. 5C illustrates schematic views for explaining an output signal of a microphone according to an incident direction of a sound source.
Figure 5B:
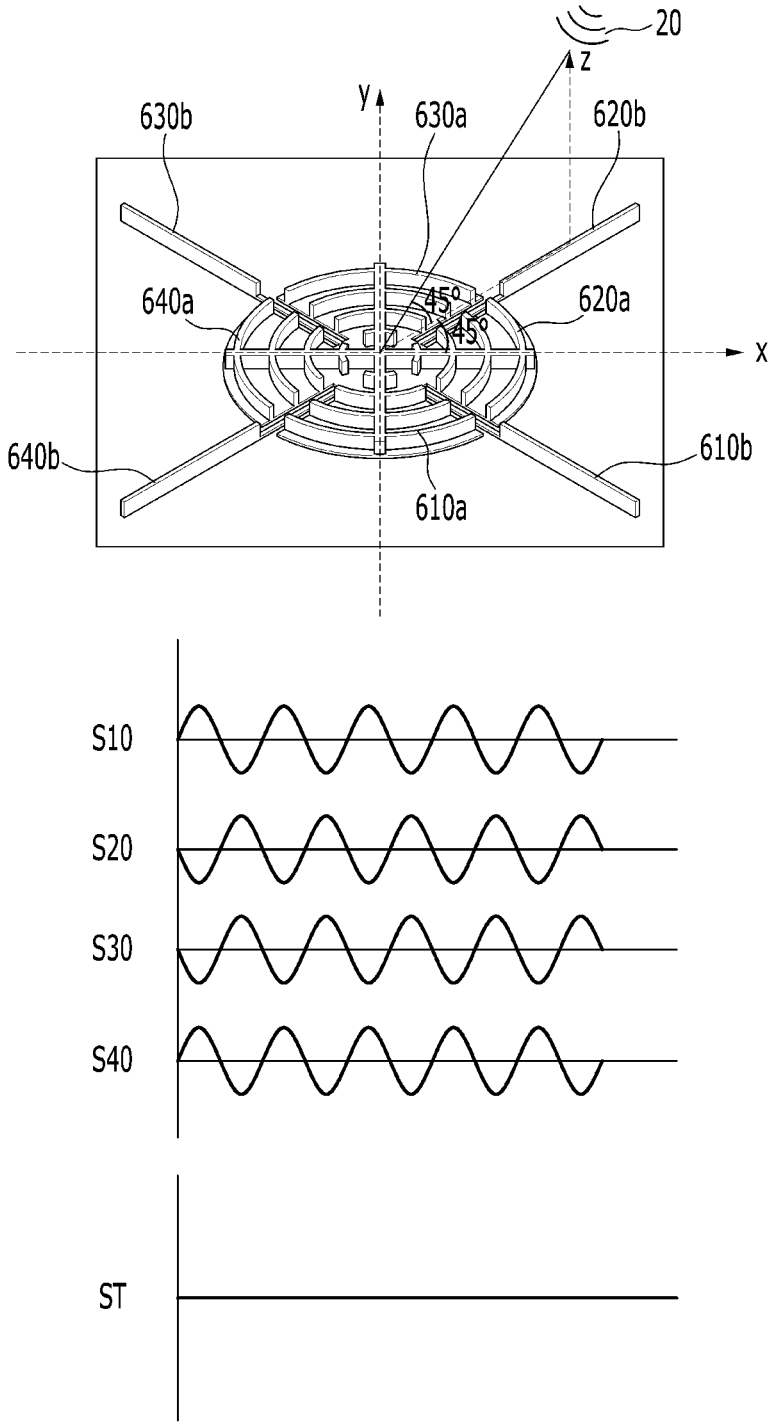
Figure 5C:
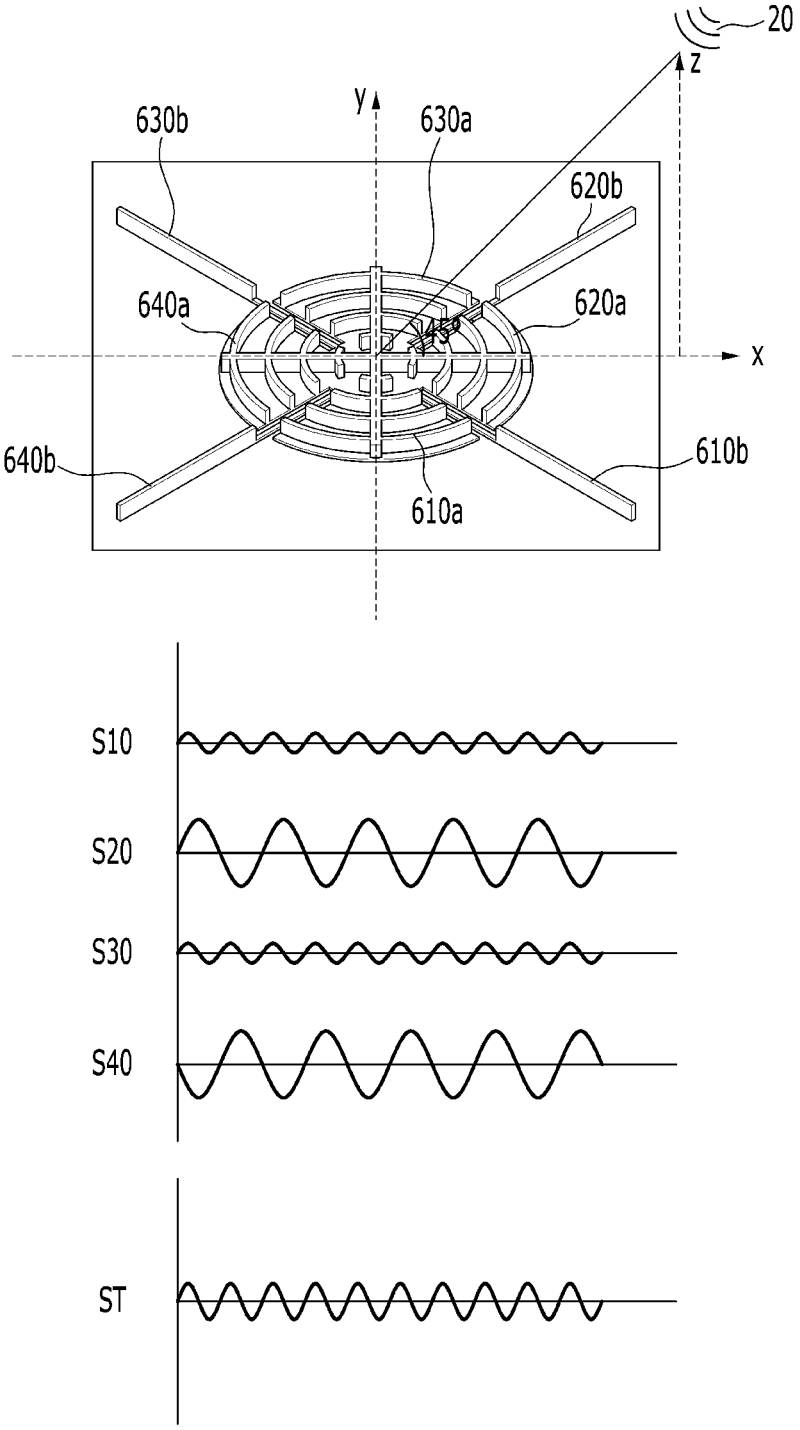

FIG. 5A to FIG. 5C illustrate schematic views for explaining an output signal of a microphone according to an incident direction of a sound source.

FIG. 5A illustrates unit output signals S10, S20, S30, and S40 and an output signal (ST) when an incident direction of a sound source 20 is a vertical direction (−z). The incident direction of the sound source 20 corresponding to the vertical direction (−z) may be a predetermined incident direction in the present exemplary embodiment.

The respective unit output signals S10, S20, S30, and S40 may be respective output signals of unit capacitors, and the output signal (ST) may be one where the unit output signals S10, S20, S30, and S40 are combined. Each of the unit output signals S10, S20, S30, and S40 may be a current or voltage signal based on the change in the capacitance of the unit capacitor.

Hereinafter, the unit capacitor will be described in detail with reference to FIG. 1 to FIG. 4.

The unit capacitor may include the vibration membrane electrode and the fixing membrane electrode facing the vibration membrane electrode. In a present exemplary embodiment, the first unit capacitor may include the vibration membrane electrode 510*a* and the fixing membrane electrode 310*a*, the second unit capacitor may include the vibration membrane electrode 520*a* and the fixing membrane electrode 320*a*, the third unit capacitor may include the vibration membrane electrode 530*a* and the fixing membrane electrode 330*a*, and the fourth unit capacitor may include the vibration membrane electrode 540*a* and the fixing membrane electrode 340*a*.

The first unit capacitor may be positioned under the vibration membrane pattern 610*a*, the second unit capacitor may be positioned under the vibration membrane pattern 620*a*, the third unit capacitor may be positioned under the vibration membrane pattern 630*a*, and the fourth unit capacitor may be positioned under the vibration membrane pattern 640*a*.

The first unit capacitor may be connected to the power source through the first pad electrode 510*c* and the second pad electrode 310*e*, the second unit capacitor may be connected to the power source through the first pad electrode 520*c* and the second pad electrode 320*e*, the third unit capacitor may be connected to the power source through the first pad electrode 530*c* and the second pad electrode 330*e*, and the fourth unit capacitor may be connected to the power source through the first pad electrode 540*c* and the second pad electrode 340*e*.

When the sound source 20 is incident, the vibration membrane electrode 510*a* of the first unit capacitor, the vibration membrane electrode 520*a* of the second unit capacitor, the vibration membrane electrode 530*a* of the third unit capacitor, and the vibration membrane electrode 540*a* of the fourth unit capacitor may vibrate according to vibration of the corresponding vibration membrane patterns 610*a*, 620*a*, 630*a*, and 640*a*. The vibration membrane electrodes 510*a*, 520*a*, 530*a*, and 540*a* may vibrate, or vibrate with different characteristics, depending on the shapes of the vibration membrane patterns 610*a*, 620*a*, 630*a*, and 640*a* and the incident direction of the sound source 20.

In the exemplary embodiment of FIG. 5A, the incident direction of the sound source 20 may be the vertical direction (−z), and wavefronts of the sound source 20 may be equally incident on the vibration membrane patterns 610*a*, 620*a*, 630*a*, and 640*a*. Accordingly, the vibration membrane patterns 610*a*, 620*a*, 630*a*, and 640*a* may vibrate in the same vibration mode, and the corresponding vibration membrane electrodes 510*a*, 520*a*, 530*a*, and 540*a* also may vibrate in the same vibration mode. Accordingly, amplitudes and phases of the unit output signals S10, S20, S30, and S40 of the first to fourth unit capacitors may be the same, respectively.

When the unit output signals S10, S20, S30, and S40 having the same amplitude and phase are combined, the output signal (ST) having the maximum amplitude may be outputted. Accordingly, according to a present exemplary embodiment, the microphone 10 may have directivity for the predetermined incident direction of the sound source 20.

The output signal (ST) may be an output signal corresponding to the sound source 20. The output signal (ST) may be a voltage signal.

FIG. 5B illustrates the unit output signals S10, S20, S30, and S40 and the output signal (ST) when an angle of the incident direction of the sound source 20 may be about 45 degrees in a counterclockwise direction and may be about 45 degrees in a vertical direction (z) in the plane based on an x-axis.

The wavefronts of the sound source 20 may be equally incident on the vibration membrane pattern 620*a* and the vibration membrane pattern 630*a*, and may be equally incident on the vibration membrane pattern 610*a* and the vibration membrane pattern 640*a*, based on the shapes of the vibration membrane patterns 610*a*, 620*a*, 630*a*, and 640*a*.

Accordingly, amplitudes and phases of the second and third unit outputs S20 and S30 may be the same, respectively, and amplitudes and phases of the first and fourth unit outputs S10 and S40 may be the same, respectively.

However, the amplitudes and phases of the second and third unit outputs S20 and S30 may be different from the amplitudes and phases of the first and fourth unit outputs S10 and S40, respectively. The shapes and sizes of the vibration membrane patterns 610*a*, 620*a*, 630*a*, and 640*a* may be designed so that the amplitudes of the second and third unit outputs S20 and S30 and the first and fourth unit outputs S10 and S40 are the same and the phases thereof are opposite to each other.

When the first to fourth unit outputs S10, S20, S30, and S40 are combined, the amplitude of the output signal (ST) may be converged to zero. Accordingly, since the microphone 10 may output a very small output signal (ST) for the sound source 20 which is not positioned in the predetermined incident direction, the microphone 10 may have directivity for the predetermined incident direction.

When the angle of the incident direction of the sound source 20 is about 135 degrees in the counterclockwise direction and is about 45 degrees in a vertical direction (z) in the plane based on the x-axis, when the angle of the incident direction of the sound source 20 is about 225 degrees in the counterclockwise direction and is about 45 degrees in a vertical direction (z) in the plane based on the x-axis, and when the angle of the incident direction of the sound source 20 is about 315 degrees in the counterclockwise direction and is about 45 degrees in a vertical direction (z) in the plane based on the x-axis, the same output signal (ST) may be outputted in the same scheme as in the exemplary embodiment of FIG. 5B.

FIG. 5C illustrates the unit output signals S10, S20, S30, and S40 and the output signal (ST) when the angle of the incident direction of the sound source 20 may be about 45 degrees in the vertical direction (z) based on the x-axis.

The wavefronts of the sound source 20 may be equally incident on the vibration membrane pattern 610*a* and the vibration membrane pattern 630*a* based on the shapes of the vibration membrane patterns 610*a*, 620*a*, 630*a*, and 640*a*. The shapes and sizes of the vibration membrane patterns 610*a*, 620*a*, 630*a*, and 640*a* may be designed so that the wavefronts of the sound source 20 incident on the vibration membrane pattern 640*a* may be delayed by a half-wave compared to the wavefronts of the sound source 20 incident on the vibration membrane pattern 620*a*.

Accordingly, the amplitudes and the phases of the first and third unit outputs S10 and S30 may be the same, respectively. The amplitudes of the second and fourth unit outputs S10 and S40 may be the same, and the phases thereof may be opposite to each other.

Accordingly, when the first to fourth unit outputs S10, S20, S30, and S40 are combined, the amplitude of the output signal (ST) may correspond to a sum of the amplitudes of the first and third unit outputs S10 and S30. The amplitude of the output signal (ST) of an exemplary embodiment of FIG. 5C may be smaller than the amplitude of the output signal (ST) of an exemplary embodiment of FIG. 5A. Since the microphone 10 may output a small output signal (ST) for the sound source 20 which may not be positioned in the predetermined incident direction, the microphone 10 may have directivity for the predetermined incident direction.

When the angle of the incident direction of the sound source 20 is about 45 degrees in the vertical direction (z) based on the y-axis, the angle of the incident direction of the sound source 20 may be about 45 degrees in the vertical direction (z) based on the −x-axis 45, and the angle of the incident direction of the sound source 20 may be about 45 degrees in the vertical direction (z) based on the −y-axis, the same output signal (ST) may be outputted in the same scheme as in the exemplary embodiment of FIG. 5C.

In the exemplary embodiments of FIGS. 5A to 5C, the output signal (ST) may be generated by simply combining the unit output signals S10, S20, S30, and S40. However, in another exemplary embodiment, when a phase of at least one of the unit output signals S10, S20, S30, and S40 is delayed by a predetermined time, the microphone 10 may have directivity for an incident direction different from the vertical direction. That is, the predetermined incident direction for the sound source 20 of the microphone 10 may be changed. For example, when the unit output signals S20 and S30 are delayed by a half-wavelength phase and then they are combined with the unit output signals S10 and S40, the output signal (ST) may have the maximum amplitude in the exemplary embodiment of FIG. 5B. Accordingly, in such a case, the angle of the predetermined incident direction may be 45 degrees based on the x-axis, and may be 45 degrees based on the z-axis.

FIG. 6A to FIG. 6D illustrate schematic views for explaining a manufacturing method of a microphone according to an exemplary embodiment of the present disclosure.

FIGS. 6A to 6D are based on a cross-sectional view of FIG. 2, and the manufacturing method will be described with reference to the reference numerals of FIGS. 1 to 5C.

Figure 6A:
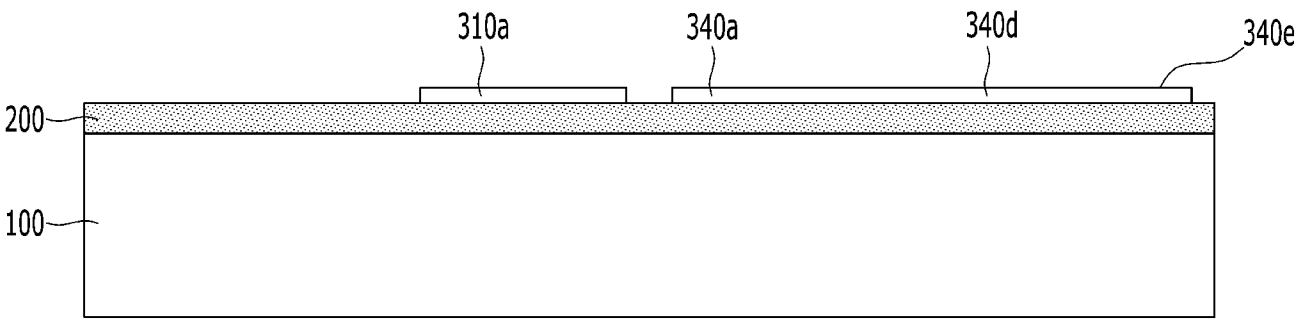
FIG. 6A to FIG. 6D illustrates schematic views for explaining a manufacturing method of a microphone according to an exemplary embodiment of the present disclosure.

Referring to FIG. 6A, the fixing membrane 200 may be formed on the substrate 100. The substrate 100 may be a silicon wafer, and before the fixing membrane 200 is deposited thereon, the substrate may be treated by thermal oxidation. A surface of the substrate 100 may be oxidized by the thermal oxidation treatment, such that a silicon oxide ($SiO_2$) layer may be formed therein. The substrate 100 treated by the thermal oxidation may serve as an insulator.

The fixing membrane 200 may be formed by depositing a silicon nitride (SiN). Alternatively, the fixing membrane 200 may be formed by depositing polysilicon.

After the fixing membrane 200 is formed, the fixing membrane electrodes 310*a*, 320*a*, 330*a*, and 340*a*, the conductive lines 310*d*, 320*d*, 330*d*, and 340*d*, and the second pad electrodes 310*e*, 320*e*, 330*e*, and 340*e* may be formed on the fixing membrane. The fixing membrane electrodes 310*a*, 320*a*, 330*a*, and 340*a*, the conductive lines 310*d*, 320*d*, 330*d*, and 340*d*, and the second pad electrodes 310*e*, 320*e*, 330*e*, and 340*e* may be formed at one time by first depositing a conductive layer and then patterning the deposited conductive layer. The conductive layer may include gold (Au) and chromium (Cr). A dry etching process may be used to pattern the deposited conductive layer.

Figure 6B:
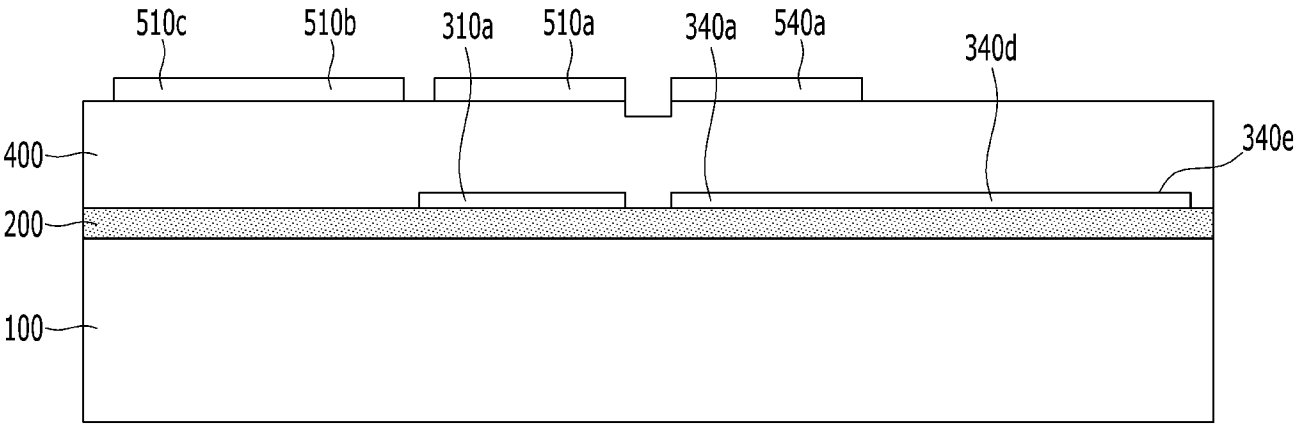

Referring to FIG. 6B, the sacrificial layer 400 may be formed on the fixing membrane 200, the fixing membrane electrodes 310*a*, 320*a*, 330*a*, and 340*a*, the conductive lines 310*d*, 320*d*, 330*d*, and 340*d*, and the second pad electrodes 310*e*, 320*e*, 330*e*, and 340*e*. The sacrificial layer 400 may be formed of a silicon oxide ($SiO_2$).

Next, the vibration membrane electrodes 510*a*, 520*a*, 530*a*, and 540*a*, the conductive lines 510*b*, 520*b*, 530*b*, and 540*b*, and the first pad electrodes 510*c*, 520*c*, 530*c*, and 540*c* may be formed on the sacrificial layer 400. The vibration membrane electrodes 510*a*, 520*a*, 530*a*, and 540*a*, the conductive lines 510*b*, 520*b*, 530*b*, and 540*b*, and the first pad electrodes 510*c*, 520*c*, 530*c*, and 540*c* may be formed at one time by first depositing a conductive layer and then patterning the deposited conductive layer. The conductive layer may include gold (Au) and chromium (Cr). A dry etching process may be used to pattern the deposited conductive layer.

Figure 6C:
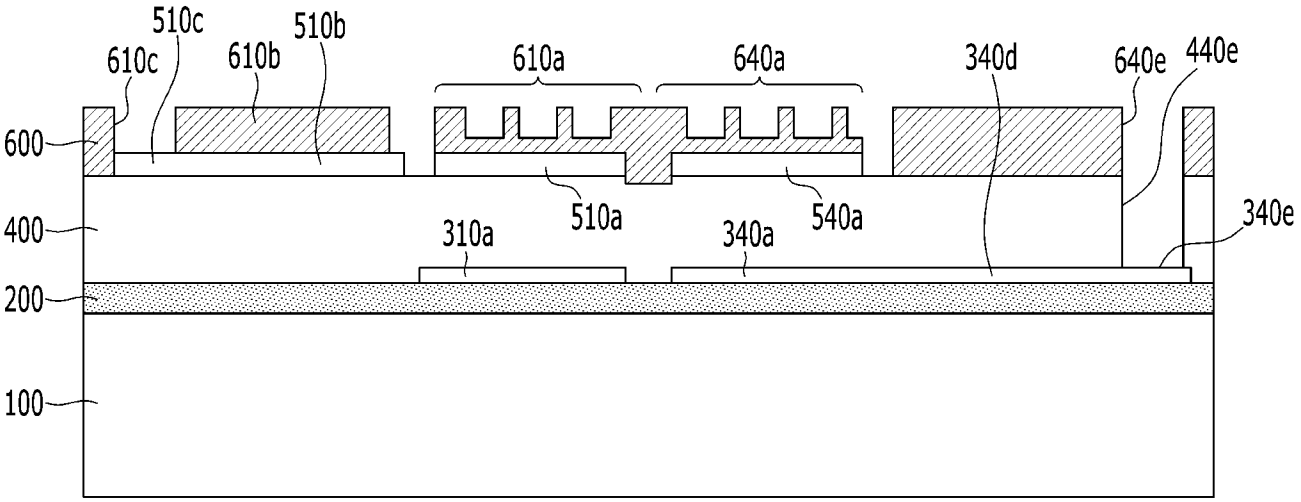

Referring to FIG. 6C, the vibration membrane 600 may be formed on the sacrificial layer 400 and the vibration membrane electrodes 510*a*, 520*a*, 530*a*, and 540*a*, the conductive lines 510*b*, 520*b*, 530*b*, and 540*b*, and the first pad electrodes 510*c*, 520*c*, 530*c*, and 540*c*.

The vibration membrane 600 may be formed by depositing a silicon nitride (SiN). Alternatively, the vibration membrane 600 may be formed by depositing polysilicon.

Next, the vibration membrane patterns 610*a*, 620*a*, 630*a*, and 640*a*, the spring patterns 610*b*, 620*b*, 630*b*, and 640*b*, the first contact holes 610*c*, 620*c*, 630*c*, and 640*c*, and the second contact holes 610*e*, 620*e*, 630*e*, and 640*e* may be formed by patterning the vibration membrane 600. Accordingly, the first pad electrodes 510*c*, 520*c*, 530*c*, and 540*c* may be exposed through the first contact holes 610*c*, 620*c*, 630*c*, and 640*c*. A dry etching process may be used to pattern the vibration membrane 600.

Next, the second contact holes 410*e*, 420*e*, 430*e*, and 440*e* may be formed in the sacrificial layer 400 to correspond to the second contact holes 610*e*, 620*e*, 630*e*, and 640*e*. Accordingly, the second pad electrodes 310*e*, 320*e*, 330*e*, and 340*e* may be exposed to correspond to the second contact holes 410*e*, 420*e*, 430*e*, 440*e*, 610*e*, 620*e*, 630*e*, and 640*e*. A wet etching process may be used to form the second contact holes 410*e*, 420*e*, 430*e*, and 440*e*.

Figure 6D:
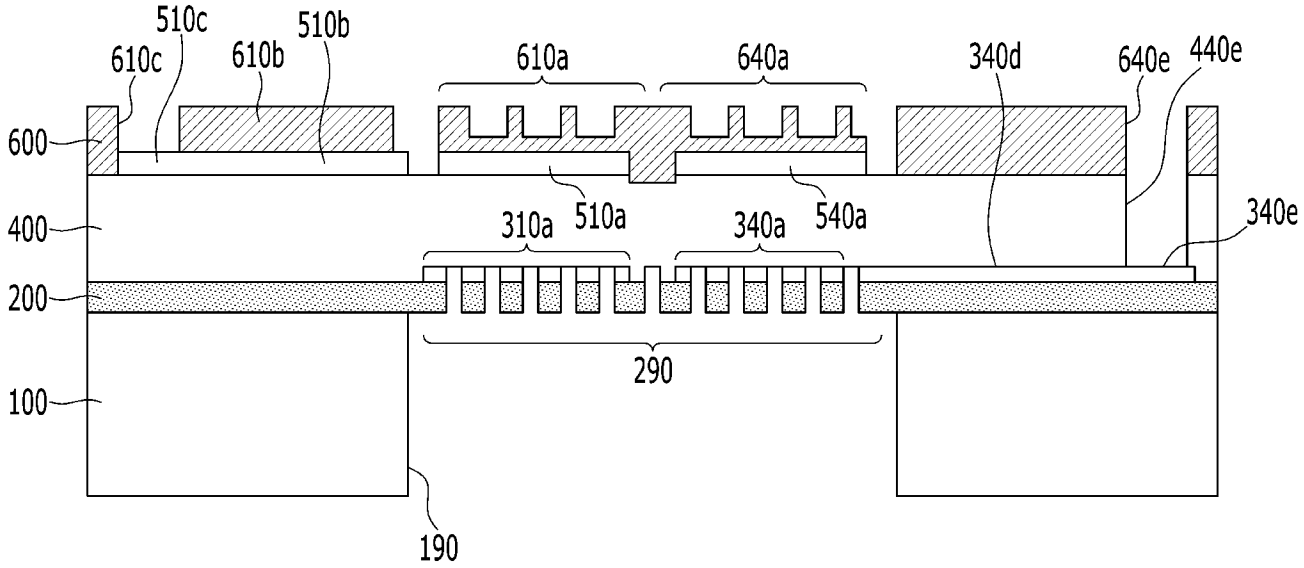

Referring to FIG. 6D, the opening 190 may be formed by back-etching the substrate 100, and an opening may be formed in each of the fixing membrane 200 and the fixing membrane electrodes 310*a*, 320*a*, 330*a*, and 340*a* by further partially etching them. A dry etching process may be used to etch the substrate 100, the fixing membrane 200, and the fixing membrane electrodes 310*a*, 320*a*, 330*a*, and 340*a*. However, a wet etching process may further be used to etch the silicon oxide layer formed in the substrate 100 by the thermal oxidation treatment.

The sacrificial layer 400 may be etched by using a wet etching process through the opening 190, the plurality of openings of the fixing membrane 200, and the plurality of openings of the fixing membrane electrodes 310*a*, 320*a*, 330*a*, and 340*a*. Accordingly, the sacrificial layer 400 may include the opening 490 as shown in FIG. 2.

The accompanying drawings and the detailed description of the disclosure are only illustrative, and are used for the purpose of describing the present disclosure but are not used to limit the meanings or scope of the present disclosure described in the claims. Therefore, those skilled in the art will understand that various modifications and other equivalent embodiments of the present disclosure are possible. Consequently, the true technical protective scope of the present disclosure must be determined based on the technical spirit of the appended claims.

What is claimed is:

1. A microphone comprising:

a plurality of vibration membrane electrodes arranged on a circular area centered on a reference point to be spaced apart from each other;

a plurality of fixing membrane electrodes that respectively faces the plurality of vibration membrane electrodes and forms a plurality of unit capacitors along with the facing vibration membrane electrodes; and a plurality of vibration membrane patterns arranged corresponding to the plurality of vibration membrane electrodes, respectively, for transmitting vibration by a sound source to the plurality of vibration membrane electrodes, wherein the plurality of unit capacitors generates a plurality of unit output signals according to inputs of a power source and the sound source, and outputs a signal combining the plurality of unit output signals as an output signal corresponding to the sound source, and wherein the plurality of vibration membrane patterns include a plurality of concentric grooves in which a center is located at the reference point.

2. The microphone of claim 1, wherein phases of the plurality of unit output signals are the same when an incident direction of the sound source is a predetermined incident direction.

3. The microphone of claim 2, wherein the plurality of vibration membrane electrodes are positioned on the same plane, and the plane is perpendicular to the predetermined incident direction.

4. The microphone of claim 3, wherein each of the plurality of vibration membrane electrodes is positioned to be spaced apart at equal intervals from the reference point, wherein the plurality of vibration membrane electrodes are arranged in different directions about the reference point and each of the plurality of vibration membrane electrodes has a sector shape having the same central angle.

5. The microphone of claim 4, wherein each of the plurality of vibration membrane patterns has a sector shape having the same central angle.

6. The microphone of claim 1, wherein each of the plurality of fixing membrane electrodes has a sector shape having the same central angle and includes an opening.

7. The microphone of claim 6, further comprising a fixing membrane contacting the plurality of fixing membrane electrodes, wherein the fixing membrane includes a plurality of openings corresponding to the plurality of fixing membrane electrodes.

8. The microphone of claim 7, further comprising a substrate contacting the fixing membrane, wherein the substrate includes openings corresponding to the plurality of openings of the fixing membrane.

9. The microphone of claim 8, wherein each of the plurality of vibration membrane patterns is connected to each other at a position corresponding to the reference point, and the microphone further includes a spring pattern connected to the position corresponding to the reference point.

10. The microphone of claim 2, wherein the predetermined incident direction is changed by delaying a phase of the unit output signal.

* * * * *